US007404299B2

(12) United States Patent
Drysdale et al.

(10) Patent No.: US 7,404,299 B2
(45) Date of Patent: Jul. 29, 2008

(54) APPARATUS, METHOD AND SOFTWARE FOR USE WITH AN AIR CONDITIONING CYCLE

(75) Inventors: Kenneth William Patterson Drysdale, Belrose (AU); Paul Thomas Eves, Watanobbi (AU); Robert Thomas Casey, Sylvania (AU)

(73) Assignee: Renewable Energy Systems Limited, Channel Islands (GB)

( * ) Notice: Subject to any disclaimer, the term of this patent is extended or adjusted under 35 U.S.C. 154(b) by 557 days.

(21) Appl. No.: 10/526,966

(22) PCT Filed: Sep. 5, 2003

(86) PCT No.: PCT/AU03/01144

§ 371 (c)(1),
(2), (4) Date: Jun. 2, 2005

(87) PCT Pub. No.: WO2004/022920

PCT Pub. Date: Mar. 18, 2004

(65) Prior Publication Data

US 2006/0026980 A1 Feb. 9, 2006

(30) Foreign Application Priority Data

| | | |
|---|---|---|
| Sep. 6, 2002 | (NZ) | 521263 |
| Sep. 30, 2002 | (NZ) | 521717 |
| Jan. 21, 2003 | (NZ) | 523733 |
| Feb. 17, 2003 | (NZ) | 524220 |

(51) Int. Cl.
*F25B 49/00* (2006.01)
*F25B 1/00* (2006.01)

(52) U.S. Cl. ..... 62/228.1; 62/498

(58) Field of Classification Search ..... 62/228.1, 62/498, 87, 404, 415, 428, 419
See application file for complete search history.

(56) References Cited

U.S. PATENT DOCUMENTS

| | | | |
|---|---|---|---|
| 4,229,689 | A | 10/1980 | Nickoladze |
| 4,361,015 | A | 11/1982 | Apte |
| 4,641,498 | A | 2/1987 | Markovitch et al. |
| 5,798,632 | A | 8/1998 | Muljadi |
| 5,864,198 | A | 1/1999 | Pinkerton |

(Continued)

FOREIGN PATENT DOCUMENTS

| | | |
|---|---|---|
| EP | 0010210 | 4/1980 |

(Continued)

*Primary Examiner*—Chen-Wen Jiang
(74) *Attorney, Agent, or Firm*—Dykema Gossett PLLC

(57) ABSTRACT

A turbine for generating power has a rotor chamber, a rotor rotatable about a central axis within the rotor chamber, and at least one nozzle for supplying a fluid from a fluid supply to the rotor to thereby drive the rotor and generate power. The flow of the fluid from the nozzle exist is periodically interrupted by at least one flow interrupter means, thereby raising a pressure of the fluid inside the nozzle. A thermo-dynamic cycle is also disclosed including a compressor, a first turbine downstream of the compressor, a heat exchanger located downstream of the first turbine and operable to reject heat from the cycle to another thermodynamic cycle, an evaporator downstream of the heat exchanger and a second turbine downstream of the evaporator and upstream of the compressor.

31 Claims, 14 Drawing Sheets

U.S. PATENT DOCUMENTS

| | | | |
|---|---|---|---|
| 5,996,347 | A | 12/1999 | Nagae et al. |
| 6,604,378 | B2 | 8/2003 | Clodic |

FOREIGN PATENT DOCUMENTS

| | | | | |
|---|---|---|---|---|
| EP | 0 136 858 | | | 4/1985 |
| FR | 2 266 799 | | | 10/1975 |
| JP | 55012278 | A | * | 1/1980 |
| SU | 892148 | | | 12/1981 |
| SU | 918729 | | | 4/1982 |
| WO | 0061997 | | | 10/2000 |
| WO | 0204788 | | | 1/2002 |

* cited by examiner

APPARATUS, METHOD AND SOFTWARE FOR USE WITH AN AIR CONDITIONING CYCLE

TECHNICAL FIELD

The present invention relates to heat pumps, turbines for use with heat pumps and/or generators for use with heat pumps, and in particular, but not exclusively, to improved refrigeration or air conditioning methods and apparatus and to turbines and/or generators for use therewith.

BACKGROUND

Present refrigeration cycles reject heat to the atmosphere. In some cases a portion of the energy which would otherwise be rejected may be recovered from the cycle, thereby increasing the overall efficiency.

FIG. 1 shows a diagrammatic representation of a heat pump circuit of the prior art. Hot, high pressure refrigerant liquid enters a throttling device, often referred to as a Tx valve, which reduces its pressure and temperature at constant enthalpy. The heat absorbing vapour is passed through a heat exchanger or "evaporator" which absorbs heat from ambient temperature air blown across its surfaces by a fan, cooling the air and thereby providing the refrigeration effect and causing it to expand. The acquisition of heat causes the liquid to flash to vapour and expand.

The heat laden working fluid vapour is then passed into an accumulator which has an internal structure designed to allow any remaining liquid to boil off prior to entering the compressor.

The energy rich warm working fluid vapour enters a compressor, which as a result of a work input, compresses the vapour thus raising its temperature and pressure. A significant portion of the work input into the compressor re-appears as the heat of compression thus superheating the working fluid vapour.

The superheated working fluid vapour thus has its temperature elevated above that of the ambient temperature of the environment and enters a condenser, which has a structure similar to that of the evaporator. A heat exchange then occurs between the superheated working fluid vapour and the environment which is at a lower temperature. The heat exchange continues until sufficient heat is removed from the working fluid to cause a change of state from hot vapour to hot liquid.

The hot working fluid liquid enters a reservoir, usually referred to as a "receiver" which has a sufficiently large volume to support the requirements of the thermodynamic cycle and withstand the high pressure in the discharge line of the compressor. The hot high pressure refrigerant liquid then enters the TX valve to complete the thermodynamic cycle.

Air conditioning systems have become a huge draw on electricity power in many of the major cities of the world and are viewed as an essential component of many large buildings in order to maintain a level of environmental control within the building. At the same time as air conditioning systems continue to increase in number, it is becoming increasingly recognised that electricity is a limited resource and in some places demand is exceeding supply or is forecast to in the near future.

It has become important to identify potential areas for saving in electricity consumption. If any savings can be made in air conditioning systems, then there is potential to make an overall huge saving in the consumption of electricity.

The saving of electricity can also lead to savings in power distribution infrastructure upgrades. Such upgrades are becoming necessary to deal with increasing peak loads introduced by a rapidly growing air conditioning market.

OBJECT OF THE INVENTION

It is an object of a preferred embodiment of the invention to provide apparatus for a heat pump and/or a heat pump which will increase the utilization of available energy in such apparatus at present.

It is an alternative object of a preferred embodiment of the invention to provide a method of controlling a heat pump which will increase the efficiency of such apparatus at present.

It is an alternative object of a preferred embodiment of the invention to provide a method of controlling a turbine and generator which will increase the efficiency of such apparatus at present.

It is a further alternative object of a preferred embodiment of the invention to provide a turbine and/or a method of communicating a fluid to a turbine which will increase the utilization of available energy from such fluid at present.

It is a still further alternative object to at least provide the public with a useful choice.

Other objects of the present invention may become apparent from the following description, which is given by way of example only.

SUMMARY OF THE INVENTION

According to a first aspect of the invention, there is provided a thermodynamic cycle including a compressor, a first turbine downstream of the compressor, a heat exchanger located downstream of the first turbine and operable to reject heat from the cycle to another thermodynamic cycle, an evaporator downstream of the heat exchanger and a second turbine downstream of the evaporator and upstream of the compressor.

According to a second aspect of the present invention, there is provided a thermodynamic cycle including a compressor, a condenser downstream of the compressor, a first turbine downstream of the condenser, an evaporator downstream of the first turbine and a second turbine downstream of the evaporator and upstream of the compressor.

Preferably, the thermodynamic cycle further includes a heat exchanger located between said first turbine and said evaporator, the heat exchanger operable to reject heat to another thermodynamic cycle.

Preferably, at least one of the first turbine and second turbine includes:

a rotor chamber;

a rotor rotatable about a central axis within said rotor chamber;

at least one nozzle including a nozzle exit for applying a fluid a fluid supply in the thermodynamic cycle to said rotor to thereby drive said rotor and generate power;

at least one exhaust aperture to, in use, exhaust said fluid from said turbine;

wherein the flow of said fluid from said at least one nozzle exit is periodically interrupted by at least one flow interrupter means, thereby raising the pressure of said fluid inside said at least one nozzle.

Preferably, the at least one of the first turbine and second turbine includes at least one fluid storage means between said fluid supply and said at least one nozzle.

Preferably, the fluid storage means has a capacity at least equal to a displacement of the compressor.

Preferably, the at least one flow interrupter means substantially stops the flow of said fluid from said at least one nozzle exit until the pressure inside said at least one nozzle rises to a preselected minimum pressure, which is less than or equal to the pressure of the fluid supply.

Preferably, in use, the flow of said fluid from said at least one nozzle is interrupted by said at least one interrupter means for a period sufficient to bring said fluid immediately upstream of said at least one outer nozzle substantially to rest.

Preferably, the rotor has a plurality of channels shaped, positioned and dimensioned to provide a turning moment about said central axis when refrigerant from said at least one nozzle enters said channels.

Preferably, the rotor is has a plurality of blades shaped, positioned and dimensioned to provide a turning moment about said central axis when refrigerant from said at least one nozzle contacts said blades.

Preferably, the at least one flow interrupter means includes at least one vane connectable to and moveable with an outer periphery of said rotor and adapted to interrupt the flow of said fluid out of said at least one outer nozzle exit when said at least one vane is substantially adjacent said at least one nozzle exit.

Preferably, the flow interrupter means includes a plurality of said vanes substantially evenly spaced apart around said outer periphery of said rotor.

Preferably, the at least one nozzle in use supplies said fluid to said rotor at a sonic or supersonic velocity.

Preferably, the at least one exhaust aperture includes diffuser and expander sections to decrease the velocity of said fluid and maintain the pressure of the fluid flow once it has decelerated to a subsonic velocity.

Preferably, at least one of the first and second turbines includes a rotor including two or more spaced apart rotor windings and a stator including a plurality of stator windings about said rotor, wherein at least two of said stator windings are connected to a controllable current source, each controllable current source operable to energise the stator windings to which it is connected.

Preferably, each controllable current source is operable to energise the stator windings to which it is connected after the rotor has reached a predetermined velocity.

Preferably, the predetermined velocity is the terminal velocity for the current operating conditions of the turbine.

Preferably, each current source increases or decreases the current through their respective stator windings dependent on a measure of the power output from the stator windings.

According to another aspect of the present invention, there is provided a method of control for the thermodynamic cycle described in the immediately preceding four paragraphs including repeatedly measuring the power output from the stator windings and increasing the current through the windings if the current measure of power output is greater than a previous measure of power output and decreasing the current through the windings if the current measure of power output is less than a previous measure of power output.

According to another aspect of the present invention, there is provided a method of generating power from a thermodynamic cycle including a compressor, a first turbine downstream of the compressor, a heat exchanger located downstream of the first turbine and operable to reject heat from the cycle to another thermodynamic cycle, an evaporator downstream of the heat exchanger and a second turbine downstream of the evaporator and upstream of the compressor, wherein the first second turbines include a rotor and at least one nozzle to apply fluid to the rotor to thereby drive said rotor and generate power;

the method including providing at least one flow interrupter means to periodically interrupt the flow of said fluid out of said at least one nozzle, thereby raising the pressure of said fluid inside said at least one nozzle to a preselected minimum pressure which is less or equal to said fluid supply means pressure before resuming the flow of said fluid out of said at least one nozzle.

According to another aspect of the present invention, there is provided a method of generating power from a thermodynamic cycle including a compressor, a condenser downstream of the compressor, a first turbine downstream of the condenser, an evaporator downstream of the first turbine and a second turbine downstream of the evaporator and upstream of the compressor wherein the first second turbines include a rotor and at least one nozzle to apply fluid to the rotor to thereby drive said rotor and generate power; the method including providing at least one flow interrupter means to periodically interrupt the flow of said fluid out of said at least one nozzle, thereby raising the pressure of said fluid inside said at least one nozzle to a preselected minimum pressure which is less or equal to said fluid supply means pressure before resuming the flow of said fluid out of said at least one nozzle.

Preferably, the preselected minimum pressure is sufficient to cause the fluid to reach the local sonic velocity at a throat of the nozzle.

Preferably, the method includes accelerating fluid exiting said at least one nozzle to supersonic velocities.

A control system for the thermodynamic cycle described in the preceding paragraphs, the control system including:

sensing means for providing a measure of an output of the thermodynamic cycle;

control means for the compressor, wherein the control means is in communication with said sensing means to receive as inputs said measure of an output of the thermodynamic cycle and a measure of the work input of the compressor;

wherein the control means is operable to compute a measure of efficiency from said inputs and vary the speed of the compressor to maximise said measure of efficiency or to maintain said measure of efficiency at a predetermined level.

Preferably, the control system further includes second control means for the second turbine and sensing means for providing a measure of the temperature of a controlled area, wherein the second control means receives as a further input said measure of the temperature of a controlled area, and is operable to open or close the fluid flow path through said second turbine in response to sensed variations in temperature in the controlled area in relation to a target measure.

Preferably, the second control means further receives as an input a measure indicative of the amount of refrigerant in the cycle which is vaporised after an evaporation phase in the cycle and to open or close the fluid flow path through said second turbine to maintain vaporised refrigerant after the evaporation phase.

Preferably, the operation of the second control means to maintain vaporised refrigerant after the evaporation phase is performed after a predetermined delay from the control means opening or closing the fluid flow path through said second turbine in response to said sensed variations of temperature.

Preferably, the control system includes third control means for a condenser in the thermodynamic cycle, the control system varying the operation of the condenser to maintain a required level of cooling of refrigerant by the condenser.

Preferably, the control means, second control means and third control means is a single microcontroller or microprocessor or a plurality of microcontrollers or microprocessors with at least selected microcontrollers or microprocessors in communication with each other to allow management of the timing of the functions of the control system.

A control system for the thermodynamic cycle described in the preceding paragraphs, the control system including:

sensing means for providing a measure of an output of the thermodynamic cycle;

control means for the compressor, wherein the control means is in communication with said sensing means to receive as inputs said measure of an output of the thermodynamic cycle and a measure of the work input of the compressor;

wherein the control means is operable to compute a measure of efficiency from said inputs and vary the speed of the compressor to maximise said measure of efficiency or to maintain said measure of efficiency at a predetermined level and wherein the control system is operable to control the direct current through the stator windings of said turbine.

Preferably, the control system is operable control the direct current through the stator windings to dynamically maintain the balance of said turbine when loaded.

Further aspects of the present invention, which should be considered in all its novel aspects, will become apparent from the following description, given by way of example only and with reference to the accompanying drawings.

BRIEF DESCRIPTION OF PREFERRED EMBODIMENTS OF THE INVENTION

The present invention is described herein with reference to its application to a refrigeration cycle. Those skilled in the art will recognise that the heat pumping circuit described may have a variety of uses, for example air conditioning, refrigeration or heating. Those skilled in art will also recognise that the term "refrigerant" is used to describe any working fluid suitable for use in such a circuit or cycle.

Figure 1:
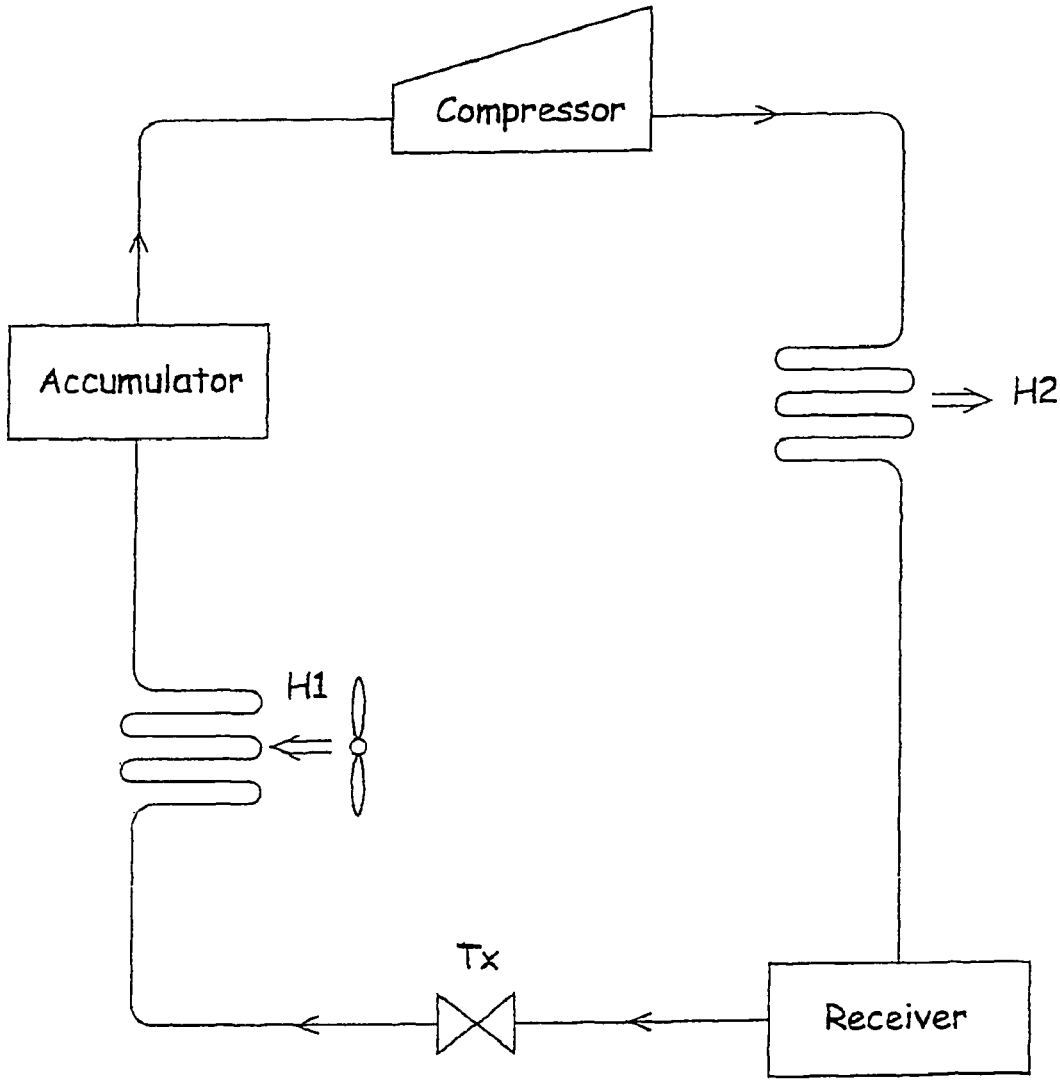
Prior Art FIGURE 1
FIG. 1: Shows a prior art thermodynamic cycle.

A simple refrigeration circuit of the prior art shown in FIG. 1 may include, in order, a compressor, a condenser, a receiver, a throttling valve (TX valve), an evaporator and an accumulator. Some embodiments of the prior art may combine two of the elements shown in FIG. 1 into a single device, for example some compressors may also include an accumulator, but the function of each element is usually present in the circuit.

The term "turbine" is used herein to describe a device which converts energy from a fluid stream into kinetic and/or electrical energy. Those skilled in the art will appreciate that where the energy is required in electrical form the turbine may include a suitable electric power generator or alternator.

Figure 2:
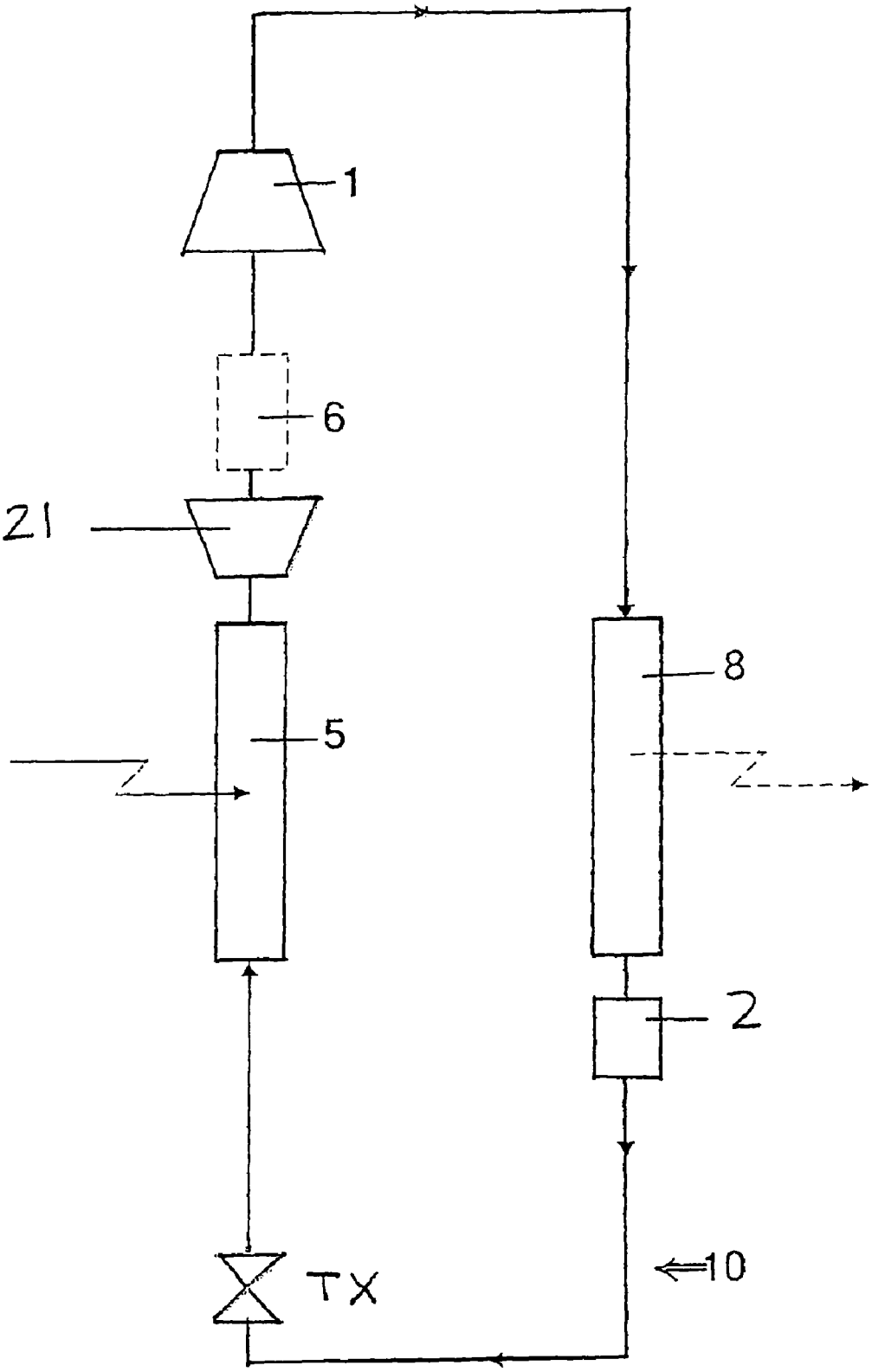
FIG. 2: Shows a first thermodynamic cycle according to an aspect of the present invention.

Referring next to FIG. 2 a heat pump apparatus of the present invention includes a first refrigerant circuit 10, which includes in order, a first compressor 1 a condenser 8, a receiver 2, a TX valve, an evaporator 5 and a turbine 21. The turbine 21 converts energy from the refrigerant into kinetic and/or electrical energy, thereby lowering the temperature and pressure of the first refrigerant. If required to result in a suitable density and pressure refrigerant for the turbine, an expander (not shown) may be provided on one or both of the upstream and downstream sides of the turbine 21.

In some embodiments the turbine 21 may be designed to avoid cooling the refrigerant to the point where drops of liquid refrigerant form within the turbine 21, as this may damage the working surfaces within the turbine 21. In alternative embodiments the turbine 21 may be adapted, for example through the use of appropriately robust materials to construct the rotor blades, to allow condensation of the refrigerant without damage to the turbine 21.

Those skilled in the art will appreciate which qualities of the refrigerant passing through the first evaporator 5 will affect the heat flow into the first evaporator 5. The refrigerant leaving the first evaporator 5 passes through a first accumulator 6 before returning to the first compressor 1. Those skilled in the art will appreciate that the receiver 2 and accumulator 6 provides the refrigerant reservoirs for the circuit. The accumulator 6 is shown in outline to represent the option that it forms a part of the compressor 1.

Figure 3:
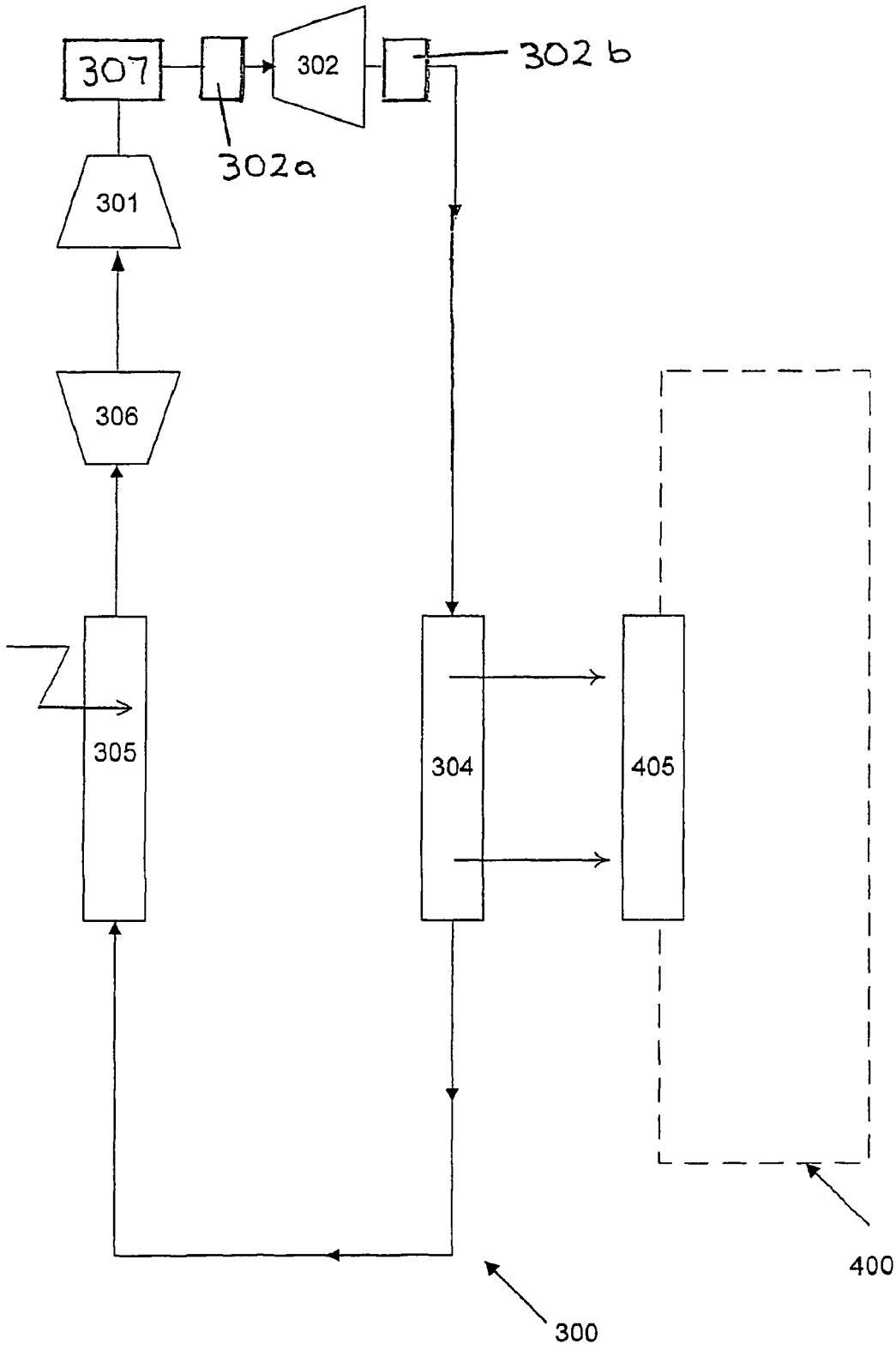
FIG. 3: Shows a second thermodynamic cycle according to an aspect of the present invention.

Referring to FIG. 3, an alternative heat pump according to the present invention is shown, which includes a first refrigerant circuit 300 and second refrigerant circuit 400. In a preferred embodiment the second refrigerant cycle 400 may include an evaporator 405, accumulator, compressor, condenser, receiver and TX valve (not shown), arranged in the same order and performing the substantially same function as a refrigeration circuit of the prior art. The second refrigerant may have a boiling point of less than 10° C., more preferably around 0° C. A suitable second refrigerant may be R22, R134A or R123, although those skilled in the art will appreciate that other refrigerants with suitably low boiling points may be used.

The second refrigerant circuit 400 may be controlled by a control system as described below with reference to FIG. 7. If required, both refrigerant circuits may be controlled by a single controller.

In a preferred embodiment the temperature of the refrigerant entering the condenser of the refrigerant circuit 400 may be above 30° C., and preferably around 60° C. The temperature of the refrigerant entering the evaporator of the refrigerant circuit 400 may be at least 10° C. lower than the temperature of the refrigerant entering the condenser 304.

In some embodiments one or more thermoelectric generators positioned between a compressor and condenser may be provided in order to generate electricity. Thermoelectric generators may be particularly useful if the refrigerant used is R123, as the condensing temperature may be as high as 180° C. and the evaporation temperature between 35° C. and 10° C., thereby providing a large temperature differential.

The cycle 300 includes in clockwise order a compressor 301, condenser 307, first expander 302*a*, first turbine 302, second expander 302*b*, a heat exchanger 304, an evaporator 305 and a second turbine 306.

The expanders may be included on both the input and output sides of the turbine 302 to reduce the density of the working fluid entering the turbine 302, and to assist in maintaining a low pressure at the output of the turbine 302 after the working fluid returns to a subsonic velocity. In a preferred embodiment the expander may ensure that there is no increase in the pressure of the fluid once it has decelerated to a subsonic velocity. Without an expander the pressure at the turbine output would otherwise rise and impair the turbine performance.

Expanders (not shown) may also be included on one or both of the input and output of the second turbine 306. The expanders will include a diffuser if the refrigerant is circulating at supersonic speeds out of the turbine 306. The expanders on the inputs of the turbines 302, 306 are necessary to lower the density of the working fluid prior to entering the throat of the turbine nozzle. The lower density will allow a larger throat size at the sonic point of the working fluid and hence maintain a critical minimum mass flow rate so as to avoid any reduction in air conditioning efficiency. Ideally the mass flow rate should be the same as would be experienced without the introduction of each turbine into the thermodynamic cycle. The volumetric expansion before the nozzle therefore lowers the density of the working fluid and allows a larger diameter nozzle throat to be used without impairing either the subsonic/supersonic transition of the working fluid at the throat or its mass flow rate.

In two further alternative cycles, one of either the refrigerant cycle 400 and condenser 304 may be omitted.

Figure 4:
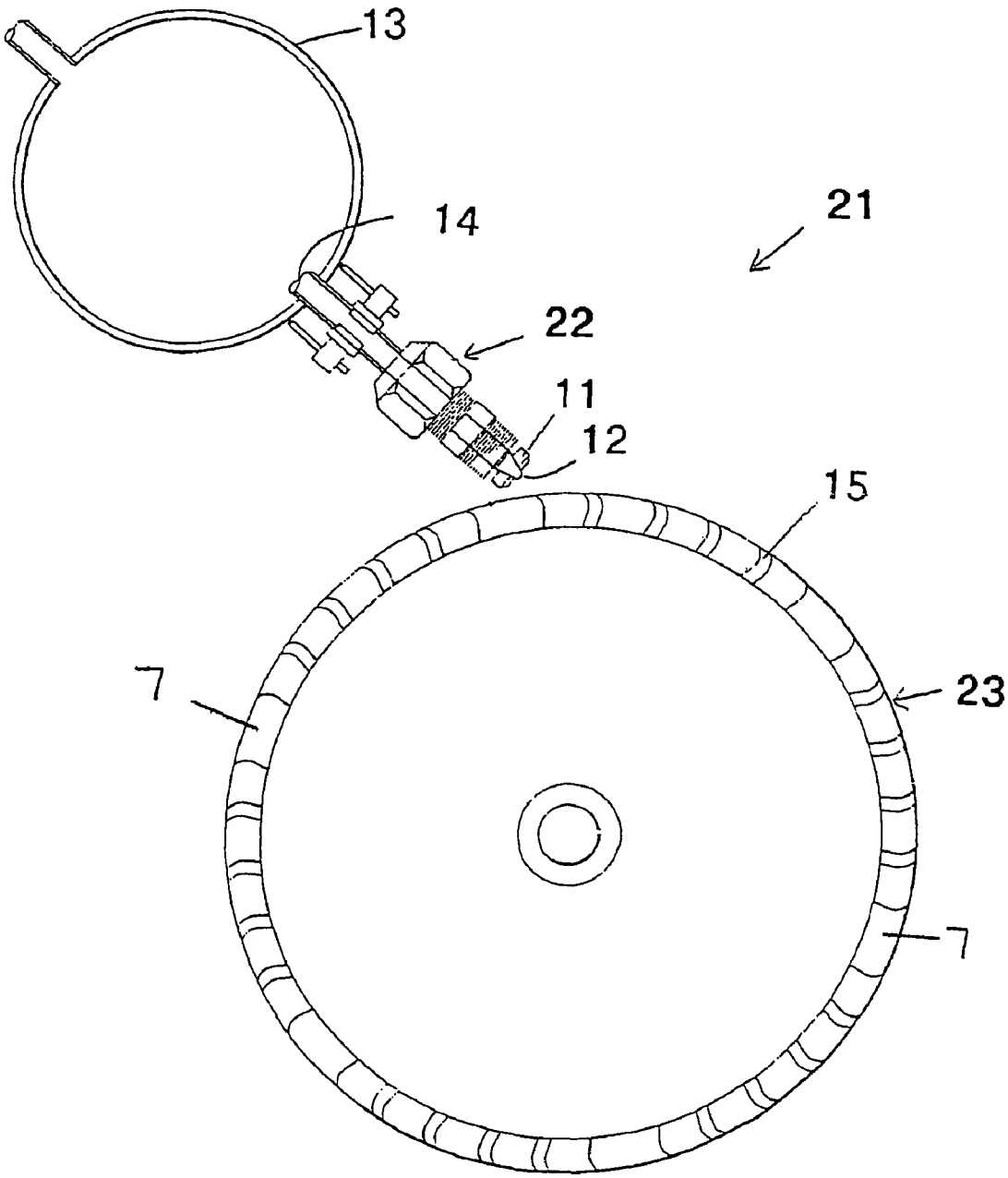
FIG. 4: Shows a cross-sectional view of a first turbine according to an aspect of the present invention.

FIG. 4 shows a turbine 21, suitable for use with the heat pump apparatus described in relation to FIGS. 1, 2, 3. The turbine 21 may also be used in a refrigerant circuit of the prior art, such as the circuit shown in FIG. 1 or in other refrigerant circuit, preferably either immediately upstream or downstream of the compressor, with expanders provided about the turbine 21 if necessary. The turbine 21 includes at least one outer nozzle 22 mounted in the housing (not shown) of the turbine 21, which has a converging/diverging section adapted to accelerate the refrigerant flowing through it to sonic or supersonic speeds.

The turbine 21 is described below with reference to its use as part of a heat pump circuit, such as those described above, in which the working fluid is refrigerant. The turbine 21 may perform the function of a TX valve in addition to generating power, allowing a TX valve to be omitted from the circuit. Those skilled in the art will appreciate that other applications for the turbine 21 are possible and that the working fluid may in these embodiments be some other suitable gaseous fluid.

The flow from each outer nozzle 22 is periodically interrupted by an interruption means. Two preferred interruption means are explained below. Those skilled in the relevant arts may be able to identify alternative means for interrupting the flow from an outer nozzle 22.

A first interruption means may include one or more vanes 7 located proximate the outer periphery of the turbine rotor 23 and adapted to substantially prevent refrigerant from flowing from an outer nozzle 22 when the vane 7 is proximate the outer nozzle outlet 12. Those skilled in the relevant arts will appreciate that the gap between the exit of the outer nozzle 22 and the vanes 7 is exaggerated in FIG. 4 and that the actual gap will be small enough to interrupt or significantly inhibit flow from the nozzle 22 when the vanes 7 are adjacent the nozzle exit 12.

A second interruption means 11 may include an electronically operated valve proximate the outer nozzle outlet 12. The second interruption means 11 may have an extremely fast response and may, for example, be similar in operation to an electronically operated common rail diesel injector.

A refrigerant storage vessel 13 may be located proximate the outer nozzle entrance 14. If the compressor supplying refrigerant to the outer nozzle 22 is a positive displacement compressor, then the refrigerant storage vessel 13 may have an internal volume at least equal to a single displacement of the first compressor. The refrigerant storage vessel 13 may have any capacity greater than the displacement of the compressor. The refrigerant storage vessel 13 may preferably be an insulated spherical container located as close as possible to the outer nozzle entrance 14.

The vanes 7 and second interruption means 11 may stop the flow of refrigerant sufficiently rapidly to cause an adiabatic pressure rise in the outer nozzle 22 without a corresponding increase in enthalpy. The flow of refrigerant may be interrupted for a period which is sufficiently long for the pressure inside the outer nozzle 22, and more preferably inside the refrigerant storage vessel 13, to reach a preselected minimum pressure which is less than the pressure supplied by the first compressor. This pressure may be selected to ensure that when the vanes 7 and second interruption means 11 are both open, the refrigerant exits the outer nozzle 22 at sonic or supersonic speeds.

The period of time that each vane 7 stops the flow from the outer nozzle 22 depends on the circumference of the turbine rotor 23, the rotational speed of the rotor 23 and the length of the vane 7 in the circumferential direction. In some embodiments this period of time may be sufficiently long that a second interrupter means 11 is not required.

In other embodiments the second interruption means 11 may be capable of closing sufficiently rapidly that the vanes 7 are not necessary, but in many cases the vanes 7 may provide a relatively simple interruption means, which is capable of closing the outer nozzle outlet 12 at high speed.

The refrigerant storage vessel 13, vanes 7 and second interruption means 11 may assist in increasing the amount of energy recovered from the refrigerant while still allowing sufficient refrigerant to flow to provide an adequate overall heat absorption effect from a refrigerant circuit. This may facilitate or assist the omission of a receiver and TX valve from the refrigeration circuit.

The Applicant believes that when the interruption means closes, the mass flow of the working fluid, in this case refrigerant, between the outer nozzle 22 and the high pressure source feeding the outer nozzle 22, which in most cases may be a first compressor, may decrease towards zero, and the pressure in the refrigerant storage vessel 13 and outer nozzle entrance 14 may rise towards the maximum pressure of the discharge line of the first compressor. This upward pressure excursion is a function of the decrease in mass flow rate of the fluid. When the mass flow rate is zero then the pressure difference across the outer nozzle 22 may be substantially zero, therefore the pressure at the outer nozzle entrance 14 is at a maximum and the kinetic energy change in the refrigerant is zero and the enthalpy change is zero. Thus, when the refrigerant is stopped the pressure rises at the outer nozzle entrance 14 to the maximum value provided by the compressor and the enthalpy change is zero. The Applicant also believes that if the period of time when the refrigerant is interrupted is short in comparison to the time in which the refrigerant is allowed to flow, then the deterioration in overall mass flow in a refrigerant circuit of which the turbine 21 is a component will be minimal.

The Applicant further believes that an advantage of stopping the mass flow through the outer nozzle 22 is that, if the period of the flow interruption is sufficiently short and the increase in pressure of the refrigerant occurs substantially adiabatically, there will be no change in the enthalpy of the stationary refrigerant in the outer nozzle 22. Also, if the increase in internal energy during the time when the refrigerant is stationary and the refrigerant is compressed compensates for the expansion of the refrigerant and its depletion of work during the time when the mass flow is flowing, which may be achieved by properly selecting the ratio of time during which the refrigerant flows to time in which the refrigerant is interrupted, then the enthalpy extraction process may become substantially continuous. The Applicant believes that this may result in an increased extraction of enthalpy from the working fluid over systems of the prior art.

Those skilled in the art will also appreciate that the timing of the second interruption means 11 may be controlled by a processing means (not shown). The processing means may receive information on the angular position of the turbine rotor 23 from any suitable means, but preferably from a hall effect sensor or similar mounted on the turbine housing (not shown), which may sense a suitable index mark on the rotor 23. The processing means may also vary the speed of the turbine rotor 23 by varying the opening times of the second interrupter 11.

Figure 11:
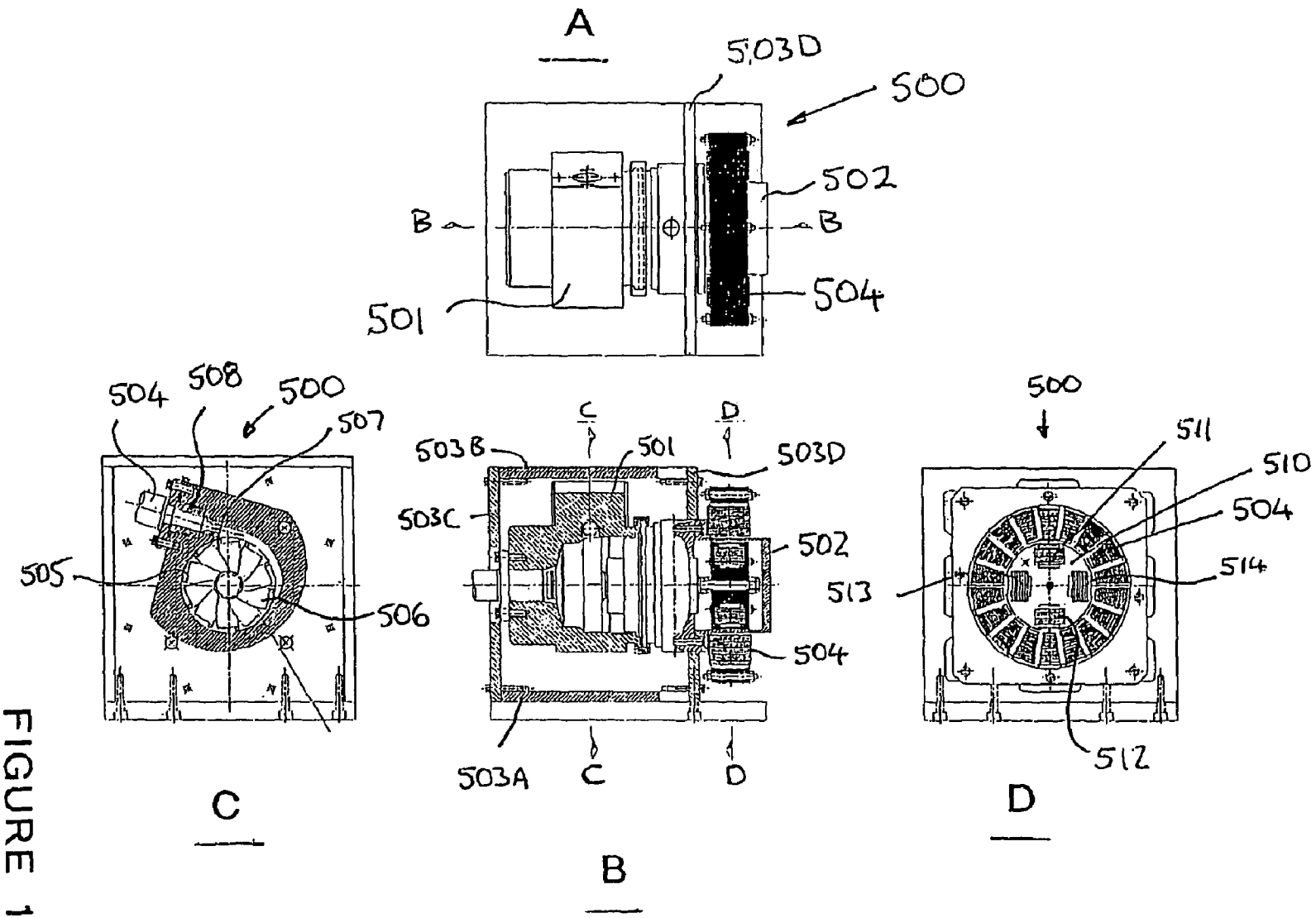
FIG. 11: Shows a diagram of a generator according to an aspect of the present invention.

While the turbine rotor 23 is shown having an impulse type blade configuration, the Applicant has found that interrupters as described above are also particularly suited to use with other radial type turbine designs, for example those used in automotive turbochargers, as is shown in FIG. 11.

Figure 5:
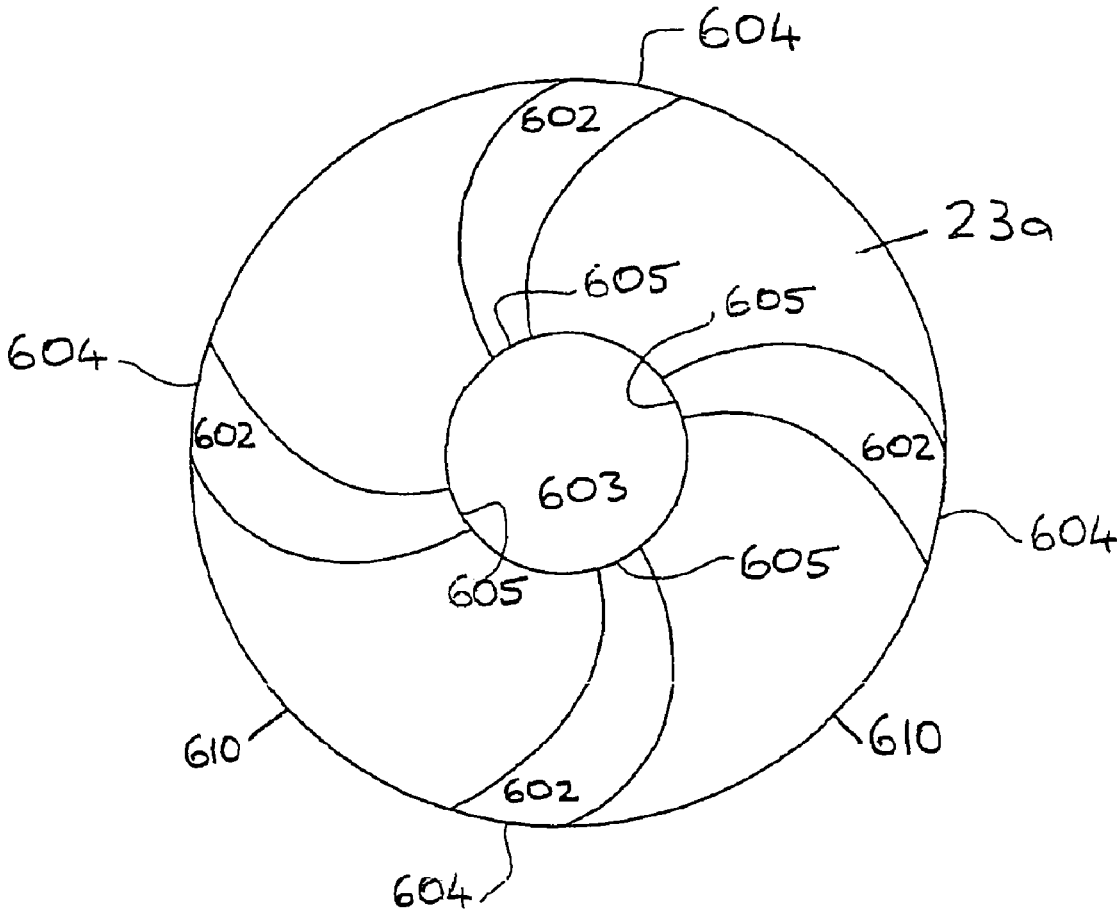
FIG. 5: Shows a cross-sectional view of a second turbine according to an aspect of the present invention.

Referring now to FIG. 5, an alternative turbine rotor 23A is shown as having a plurality of substantially spiral shaped channels 602 leading to a central exhaust aperture 603. The central exhaust aperture 603 may be central of the rotor 23A and may extend substantially in the direction of the central axis of the rotor 23A. The cross-sectional area of each channel 602 may continuously decrease between an inlet 604 and an outlet 605.

Preferably the ratio of the area of the inlet 604 to the outlet 605 may be substantially 6:1 in order to promote hypersonic operation with the minimum restriction to the flow of the working fluid.

Figure 6:
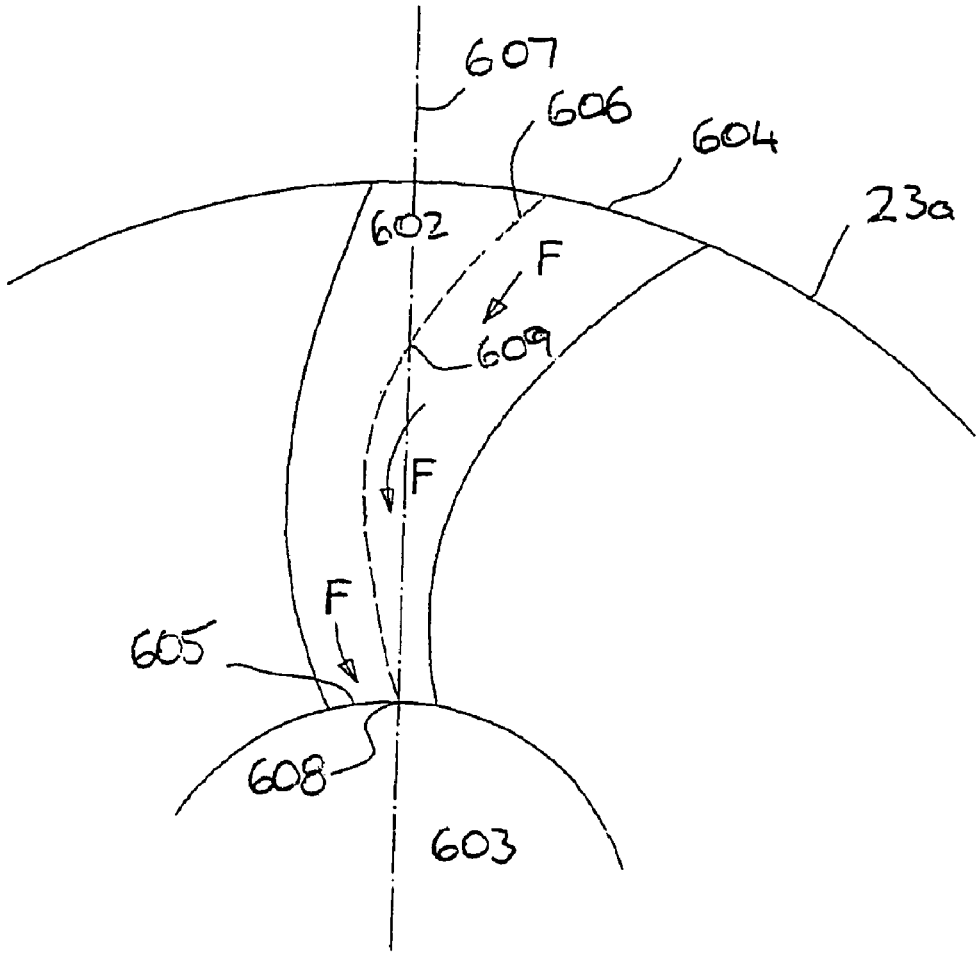
FIG. 6: Shows an enlarged view of a channel of the turbine of FIG. 5.

Referring next to FIG. 6, the centreline 606 of each channel 602 may intersect a radius 607 of the rotor 23A on at least two points, 608, 609 between the inlet 604 and the outlet 605.

A fluid flow, represented by arrows F, may enter a channel 602 through an inlet 604. As the direction of the fluid F is changed within the channel 602 the change in momentum of the fluid F may result in a turning force on the rotor 23A. Preferably the turning force may be transmitted to either a suitable electrical energy generator or any other suitable mechanism which may be powered by a rotating shaft. It is preferred that the fluid F execute as close as possible to a 180° change in direction within the channel 602 in order to maximise the change in momentum and therefore the energy imparted to the rotor 23A.

The rotor 23A may be used with an electronic second interrupter means as described above, although those skilled in the art will recognize that the in some embodiments the spacing 610 between the channel entrances 604 may act as an interrupter means.

Figure 7:
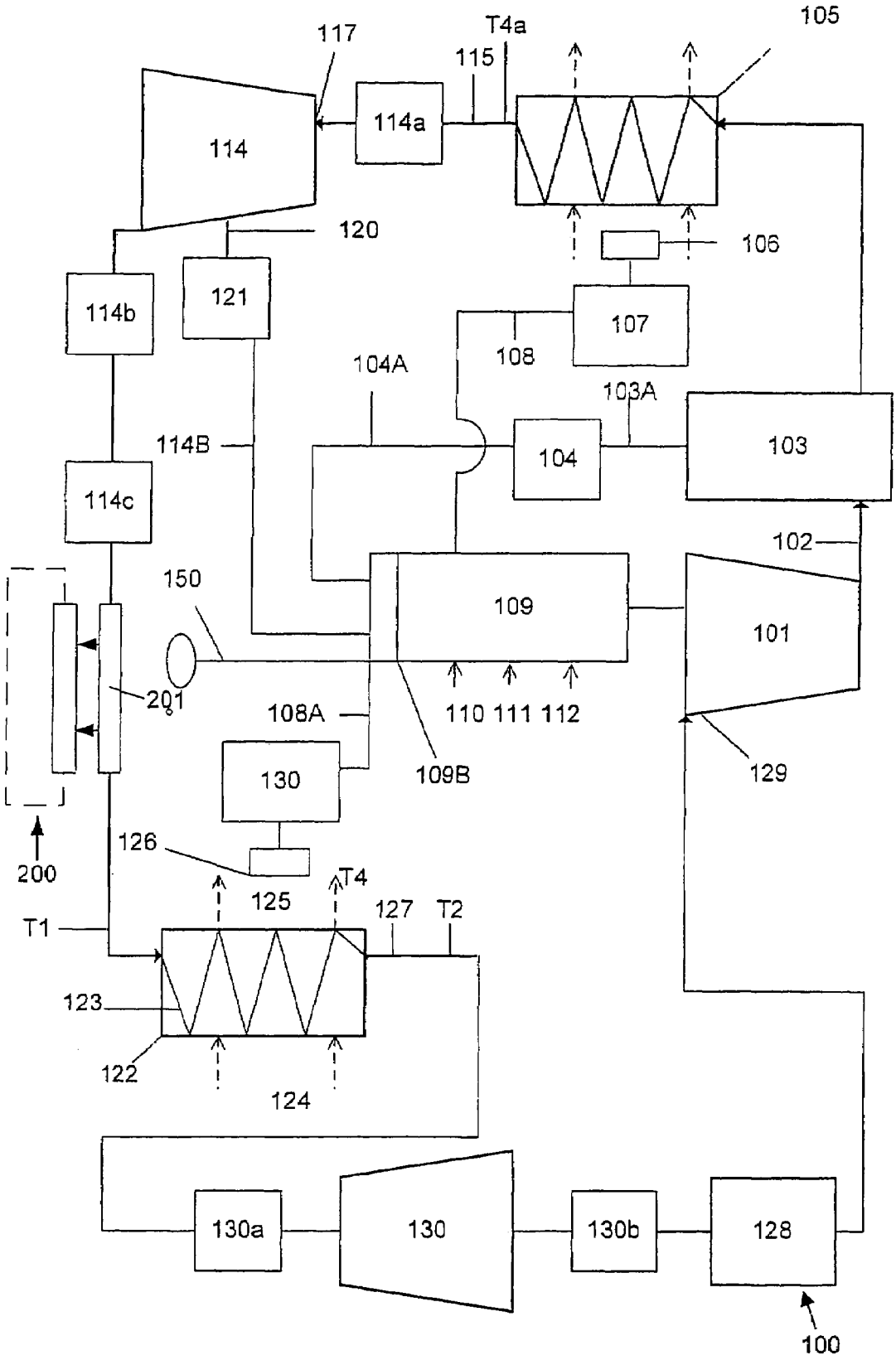
FIG. 7: Shows a third thermodynamic cycle illustrating a control system according to an aspect of the present invention.

FIG. 7 shows an air conditioning/refrigeration cycle, generally referenced by arrow 100, according to another aspect of the present invention.

Like the cycle 300 shown in FIG. 3, the cycle 100 may differ from air conditioning or refrigeration cycles of the prior art in that the TX valve and receiver common to the cycles of the prior art, may be omitted. The TX valve is replaced by a turbine 114, which in this embodiment is located between the condenser 105 and evaporator 122. An optional thermoelectric generator 103 may precede the condenser 105.

A second turbine 130 is placed between the output of evaporator 122 and the accumulator 128. Expander 130*a* and 130*b* if present are placed about turbine 130. This is to ensure that the density of the working fluid entering turbine 130 is sufficiently low, so as to allow a sufficiently large diameter nozzle to be used within turbine 130, without impairing the supersonic operation of 130, the mass flow rate of the system or its cooling efficiency.

A secondary heat pump cycle referenced by arrow 200 contains a heat exchanger 201 which follows expander 114*c* and allows heat to be removed from the primary cycle 100, to ensure that the temperature and pressure of the working fluid entering evaporator 122 is sufficiently low to allow the efficient operation of evaporator 122. The secondary cycle contains all of the essential heat pump components described in the prior art cycle 10 of FIG. 1 with the additional controls referred to in FIG. 7 and described herein for cycle 100.

High pressure working fluid may exit a compressor 101 through a compressor discharge line 102 in a substantially vapour phase and may enter a thermoelectric generator 103 or may pass straight to a condenser 105. The thermoelectric generator 103, if present, may produce a low voltage DC output 103*a* which may be converted to a high voltage output 104*a* through a DC to DC converter 104.

The condenser 105 removes heat from the working fluid. The amount of heat rejected may be controlled by the speed of a condenser fan 106 which blows air over the condenser 105. The speed of the condenser fan 106 may be determined by a variable speed drive 107, controlled by a master variable speed drive 109 through a communications link 108. The variable speed drive 107 includes suitable software to control the speed of the condenser fan 106.

The master variable speed drive 109 may include thermocouple inputs 110, 111 and 112 to provide information on the temperature of refrigerant into the evaporator (T1), temperature of the refrigerant out of the evaporator (T2) and temperature of air exiting the evaporator (T4) respectively. A further thermocouple (T4*a*) and pressure sensor 115 may measure the pressure of the temperature and pressure of the working fluid entering the turbine 114.

By measuring the temperature and pressure of the working fluid entering the turbine and selected temperatures in the cycle, the software in the master variable speed drive 109 may estimate the density of the working fluid entering the turbine 114 by a software lookup table and may adjust the speed of the compressor 101 and/or condenser fan 106 and/or evaporator fan 126 to ensure that it is sufficiently low that the vapour passing through the throat of a ponverging/diverging nozzle 117, which feeds the turbine 114, is at a substantially sonic velocity. Expander 114*a* further reduces the density of the working fluid entering turbine 114.

The sonic working fluid exiting the turbine nozzle throat may continue to accelerate in a diverging section of the nozzle 117 until it reaches a supersonic velocity.

The high velocity working fluid drives the turbine rotor. The turbine may drive a load 121, for example an electric generator, via a suitable coupling 120.

Acceleration of the working fluid within the nozzle 117, preferably to sonic or supersonic velocities, may cause a fall in its temperature and pressure. Energy may then be removed from the working fluid as a result of the flowing through the turbine 114.

A mixture of high velocity low pressure working fluid in both vapour and liquid phases is passed into an evaporator 122 via expander 114*c* which is designed to prevent the working fluid pressure from rising as the working fluid decelerates having had kinetic energy removed from it by turbine 114. If necessary the expander 114*c* may also contain a diffuser 114*b* to cause the velocity of the working fluid to reduce to a subsonic value prior to entering expander 114*c*.

The evaporator coil 123 may absorb heat from the warmer air 124 outside the evaporator 122. The cooled air 125 may be removed from the evaporator 122 by an evaporator fan 126. The speed of the evaporator fan 126 may be varied by a further variable speed drive 130 connected to the power input of the evaporator fan 126 and controlled by the master variable speed drive 109 through a communications link 108*a*. The speed of the evaporator fan 126 may be varied in response to the drop in temperature of the air 124 flowing over the evaporator 122.

The accumulator 128 may ensure that any remaining liquid phase fluid is evaporated prior to entering the compressor input 129. The accumulator 128 may also act as a working fluid reservoir to replace the receiver used by some air conditioning/refrigeration cycles of the prior art.

The master variable speed drive 109 may control the speed of the compressor 101 to optimise its coefficient of performance (COP), substantially as described herein below, although the TX valve control will be omitted due to the elimination of the TX valve from the cycle 100.

If the turbine 114 is driving an electrical generator 121 then the electrical generator 121 may be either of the DC or AC type. Preferably the generator 121 may be a high voltage DC generator of the order of 670 volts output. In the preferred case the DC power output 14B may be coupled into the DC bus bar 109B of the master variable speed drive 109 through a diode and capacitor isolation circuit, which may only allow power to flow in one direction, thus avoiding any feedback of mains power 150 to the generator 121.

Those skilled in the art will recognise that the air conditioning cycles described above may be more energy efficient than those of the prior art, due to energy recovered by the turbine and, where used, the thermoelectric generator, as well as the control of the compressor speed to optimize the overall Coefficient of Performance.

Figure 8:
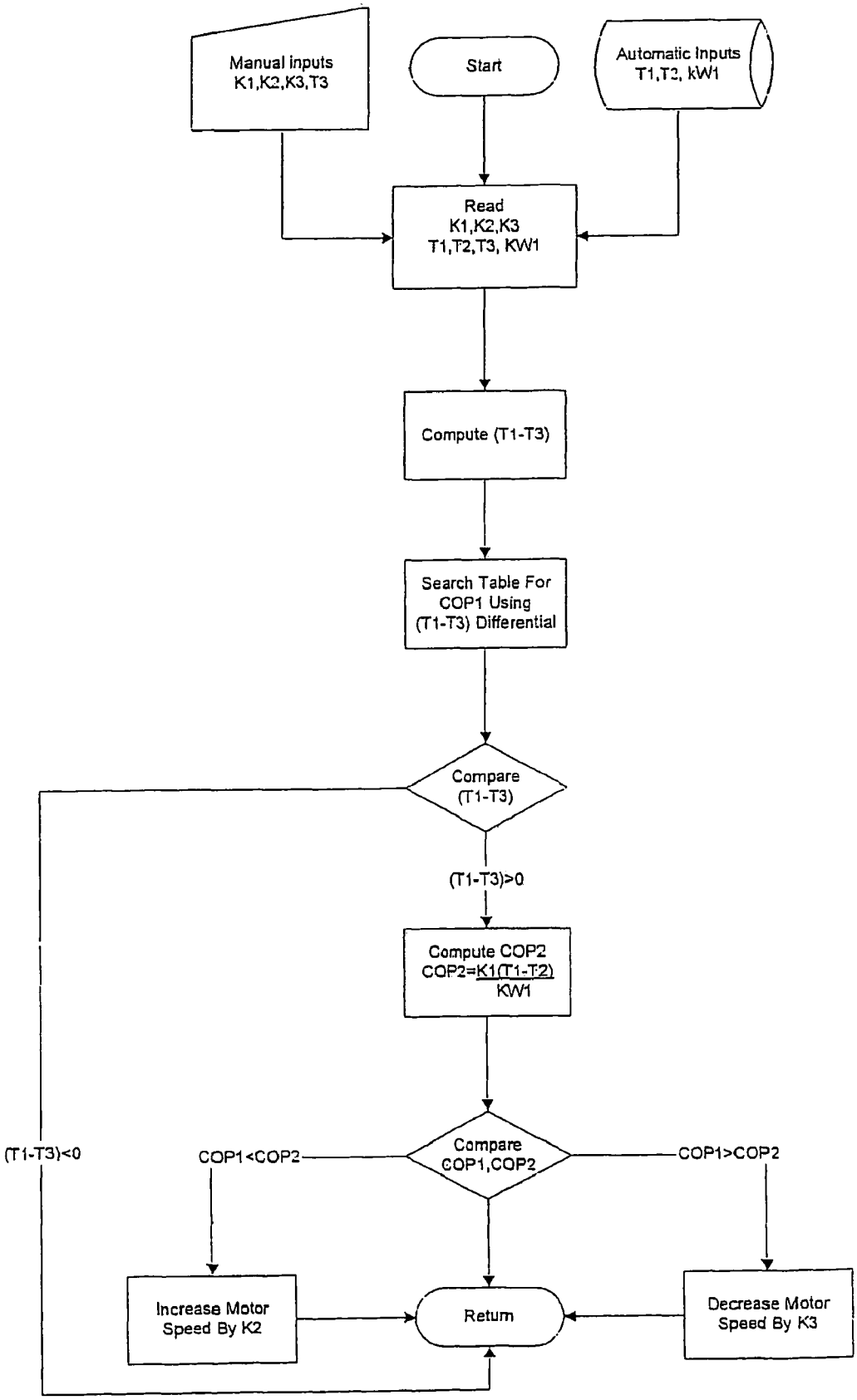
FIGS. 8-10, 12: Show flow charts of a method of controlling a thermodynamic cycle according to aspects of the present invention.
Figure 9:
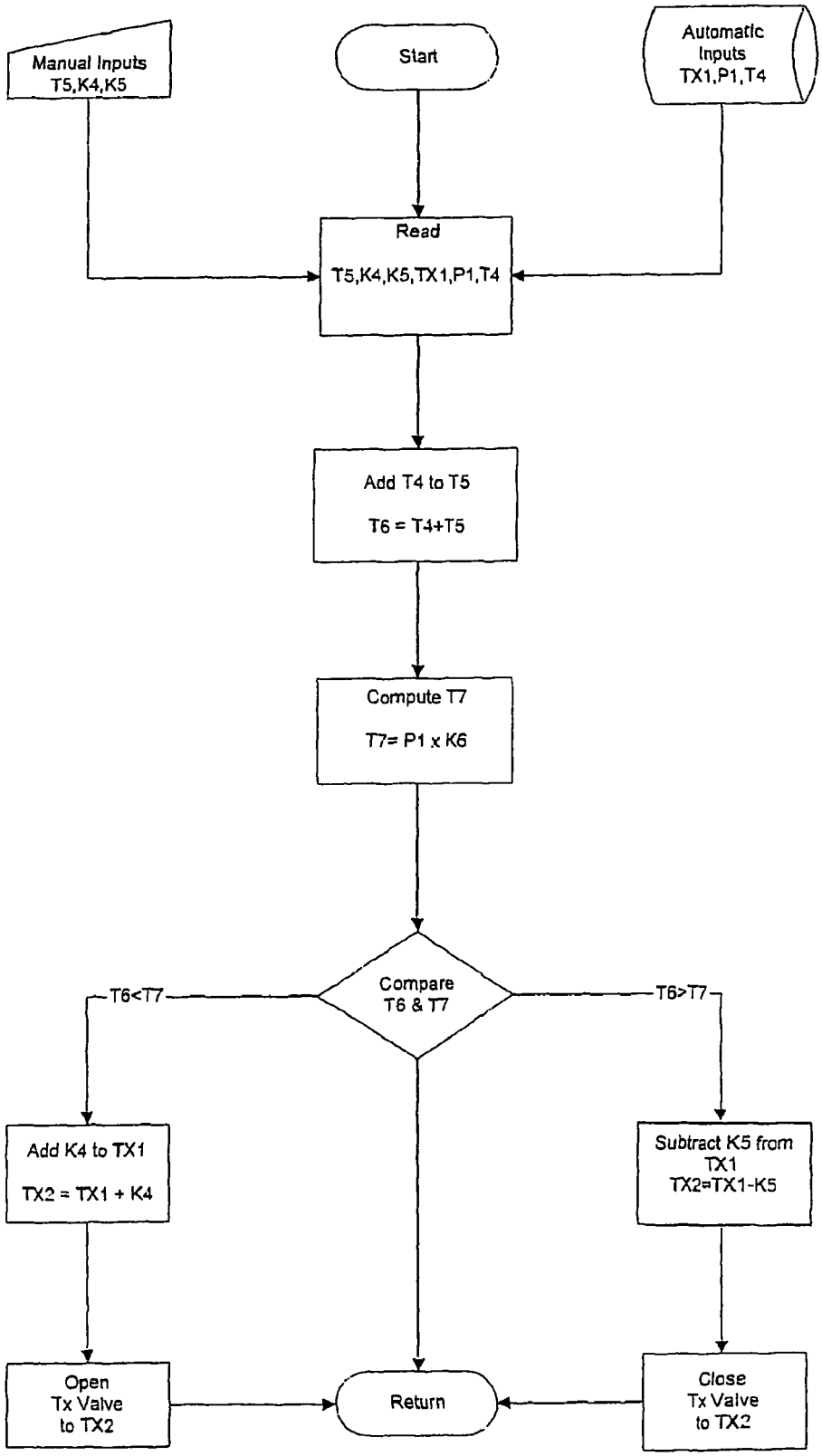
Figure 10:
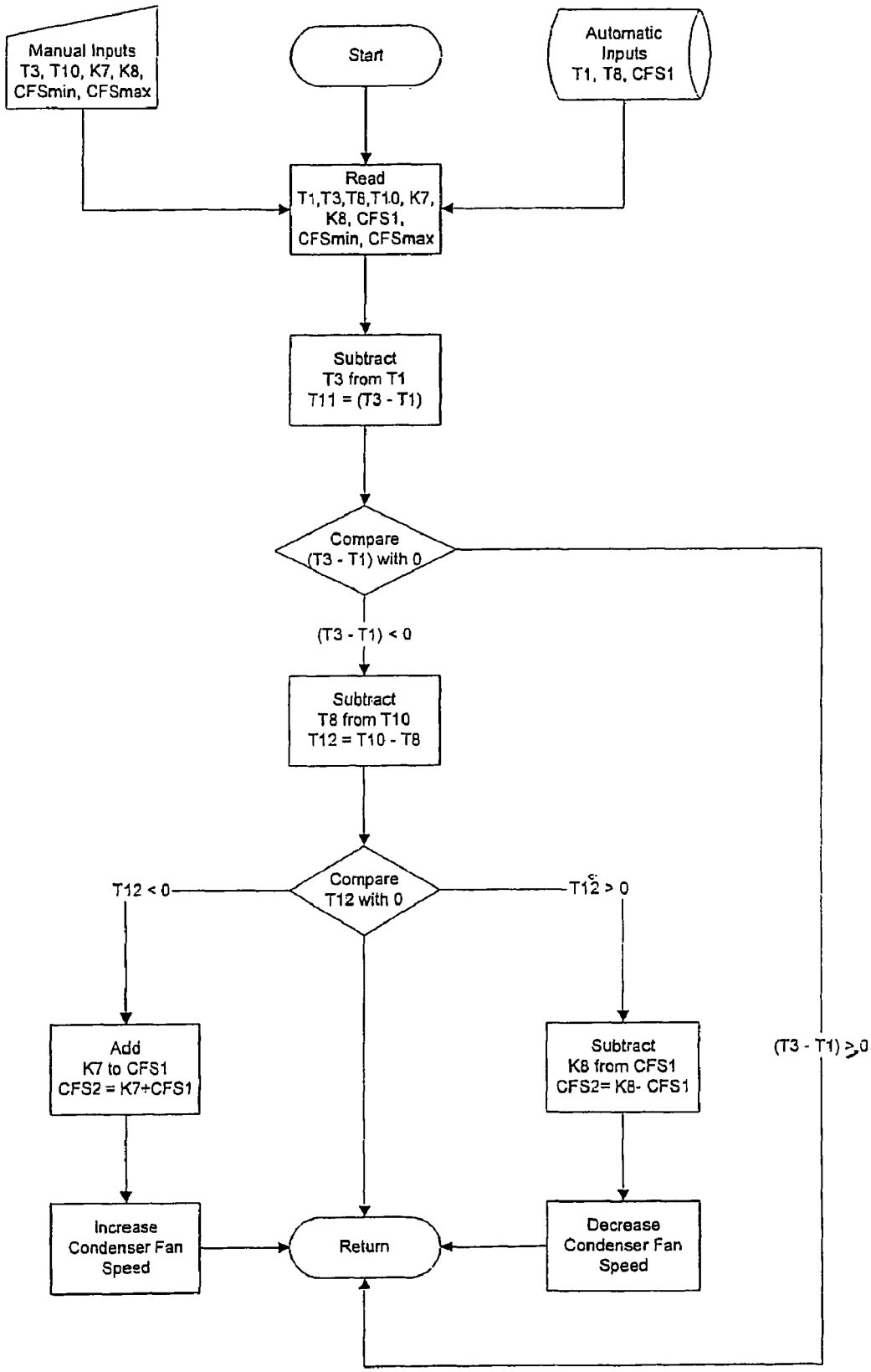

FIGS. 8 to 10 show a series of flow diagrams illustrating an example of the computational process of the present invention that may be performed to control an air conditioning cycle, such as the cycles described herein in relation to FIGS. 1, 2, 3, 7, 8 or other cycles including those of the prior art if required. The process may be controlled by any suitable microcontroller, microprocessor or similar having a control output to control the drive signal of a motor controller for a compressor. For clarity, in the following description it is assumed that a microcontroller has been used.

Referring to FIG. 8, on power up or before execution of the control algorithms, an initialisation routine may be performed in which selected flags, registers and counters may be initialised, typically by setting to zero if this is required for the particular implementation of the control algorithms.

Figure 13:
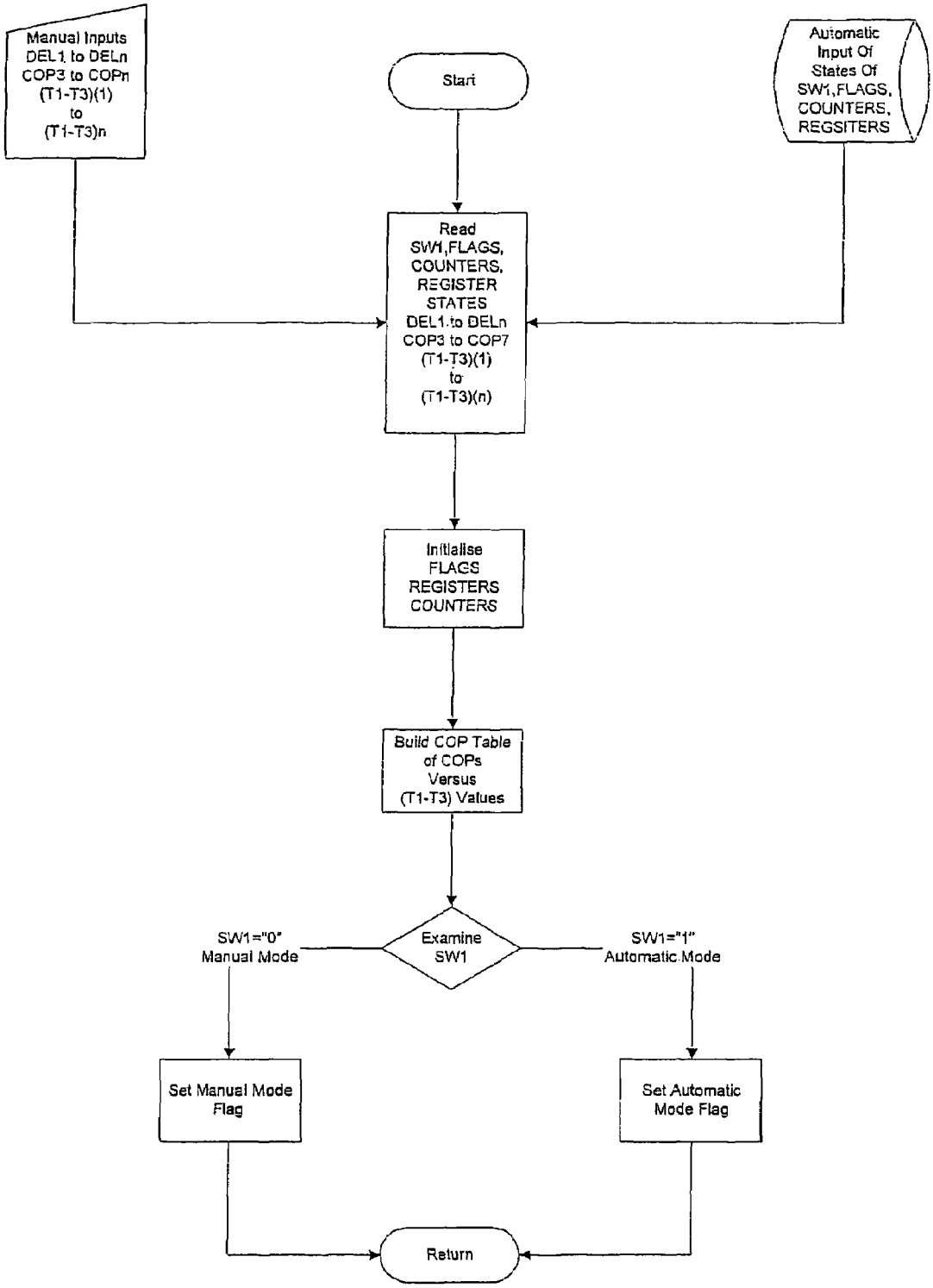
FIG. 13: Shows a flow chart of an initialisation subroutine for the control system.

Referring to FIG. 13, a flow chart illustrating a possible initialisation subrouting is shown. The time intervals at which external devices (for example the compressor, TX valve, condenser, generator excitation) are serviced/optimised are entered as DEL1 to DELn. For the particular heat pump that is being controlled, a look-up table is determined and the entries for target coefficients of performance (COP3 to COPn) for the heat pump when operated at a specific temperature differentials across the evaporator ((T1-T3)(1) to (T1-T3) (*n*)) are entered.

The microprocessor may read the state of a switch SW1. The switch SW1 dictates whether the microcontroller automatically schedules servicing/optimisation of the control parameters for the heat pump. The current is state of any required flags, counters and registers may also be read and then initialised.

A look-up table is then formed from the entered temperature differentials (T1-T3)(1) to (T1-T3)(*n*) and their associated target coefficients of performance COP3 to COPn for use in the servicing/optimisation of the heat pump (see herein below). Finally, the microcontroller sets a flag that dictates manual or automatic operation based on the status of the switch SW1.

The microcontroller receives as inputs the temperature of the refrigerant flowing into the evaporator T1, the temperature of the refrigerant leaving the evaporator T2 and the compressor motor power KW1. The set point for the heat load T3, the required motor speed increment K2 and required motor speed decrement K3 for the compressor and an air conditioning refrigerant constant K1 are also entered. K1 may be determined experimentally for the particular air conditioning cycle and represents the increment of heat lifted per degree temperature change between T1 and T2.

Having received these inputs, the microcontroller then computes the difference between T1 and T3. This difference is then used to look up a corresponding coefficient of performance for the heat pump in the stored look-up table, where the coefficient of performance represents the heat lifted per unit work input.

In an alternative embodiment, instead of working to a target COP, the microcontroller may increase/decrease the compressor speed to maximise the COP if the COP for the cycle does not just continually increase with compressor speed. Those skilled in the relevant arts will also appreciate that variables other than the temperature difference across the evaporator may be used if required.

If T1-T3 is less than or equal to zero, the heat pump is not operating and nothing further is done by the microcontroller, which returns to the start of the algorithm. If T1-T3 is greater than zero, the actual coefficient of performance COP2, which is based on the measured variables T1, T2 and KW1 is computed according to equation 1:

$$COP2=K1|T1-T2|/KW1 \qquad \text{equation 1}$$

Other measures relating the output of the cycle to the compressor work input may be used if required. As herein described, the presently contemplated preferred embodiment uses measures of temperature difference to provide a measure of the useful heat transferred by the system, as temperature measurements may be relatively easily obtained. However, alternative measures of system performance may be used that relate the system output to the compressor input.

The computed co-efficient of performance COP2 is then compared to the target coefficient of performance COP1. If the value of COP1 is less than COP2, the compressor speed is increased by K2. Conversely, if the target COP1 is greater than the computed COP2, the motor speed is decreased by K3. A delay subroutine (not illustrated) is then executed to allow for any lag in the response of the cycle to the change in compressor speed. The required time delay can be determined experimentally by forcing adjustments of the compressor speed by increments of K2 and K3 and measuring the maximum time for the air conditioning cycle to return to steady state conditions. Any suitable delay subroutine may be used to achieve this delay. The delay subroutine is completed after any control variable is changed before analysing and varying another control variable to ensure that the system remains stable and/or to ensure that steady state conditions are used to provide measures of the inputs to the control algorithms. The execution of control algorithms may be performed periodically at predetermined time intervals, continuously with the appropriate time delay between each control cycle or on a scheduled basis.

FIG. 9 shows diagrammatically a control algorithm to control the operation of a TX valve, if one is provided in the heat pump. The control algorithm may also be applied to any controllable device that performs the same or similar function to a TX valve.

The microcontroller receives as temperature inputs the unsaturated temperature of the air exiting the evaporator T4 and a constant T5 representing a superheat temperature value added to the temperature of the working fluid at the evaporator output. It also receives a pressure input P1 representing the pressure of the working fluid at the evaporator output, a measurement of the current status of a TX valve or equivalent TX1, and set steps K4 and K5 for incrementing and decrementing the operation of the TX valve respectively.

The microcontroller computes T6 as the sum of T4 and T5 and computes T7 as the product of P1 with a constant K6, which facilitates the conversion of pressure to temperature of the working fluid. If the temperature T6 is less than T7, the TX valve is opened by increment K4 and if the temperature T6 is greater than T7, the TX valve is closed by increment K5. Otherwise, the TX valve is maintained in its current position. The incremental and decremental step size may optionally be the same (K4=K5). A delay subroutine is then executed in order to allow the cycle to reach a steady state or near steady state before any further action is taken.

With variation of the TX valve setting, it may be advantageous to check that the TX valve is still operating so that the refrigerant in the suction line of the compressor after the evaporator is sufficiently super heated to be at the vapour state. Therefore, each time when the delay subroutine following variation of the TX valve is invoked, the microcontroller may perform an additional check on the operation of the TX valve. This check may only be necessary if the control over the limits of operation of the TX valve is not already present as part of the TX valve and if the existing control algorithms do not bound the TX valve within an acceptable operating range.

With variations in the compressor speed and TX valve opening, the operation of the condenser will also vary. Therefore, the controller may also control the drive fan to a condenser. This process is shown in FIG. 10.

The temperature inputs to the algorithm are T1 and T3 as defined herein above, the liquid line temperature T8, measured at a predetermined point in the heat pump, typically at a point immediately following the condenser and the target temperature for the liquid line temperature T10. The step size for an increment in condenser fan speed K7 and step size for an increment in condenser fan speed K8 are also inputs to the algorithm together with the current condenser fan speed CFS1, minimum condenser fan speed CFSmin and maximum condenser fan speed CFSmax. Although the steps that use CFSmin and CFSmax are not illustrated in FIG. 11 the values of CFSmin and CFSmax bound the allowable speed of the compressor fan.

The microcontroller first calculates T11 as the difference between T3 and T1 and terminates the control algorithm for the condenser fan speed if T3 is greater than or equal to T1. If T3 is less than T1, the cycle is operational and heat extracted by the condenser. The microcontroller then calculates T12 as the difference of T10 and T8 and if the target temperature T10 is less than the actual temperature T8 the current compressor speed CFS1 is increased by K7 and if T10 is greater than T8 the current compressor speed is decreased by K8. A further time delay is invoked after variation of the condenser fan operation.

The microprocessor may also vary the timing of the second interrupter 11 to optimize a selected parameter of each refrigerant circuit. In some embodiments the heat absorbed by an evaporator may be the selected parameter, while in other embodiments the total power input one or more of the compressors may be the selected parameter.

Figure 14:
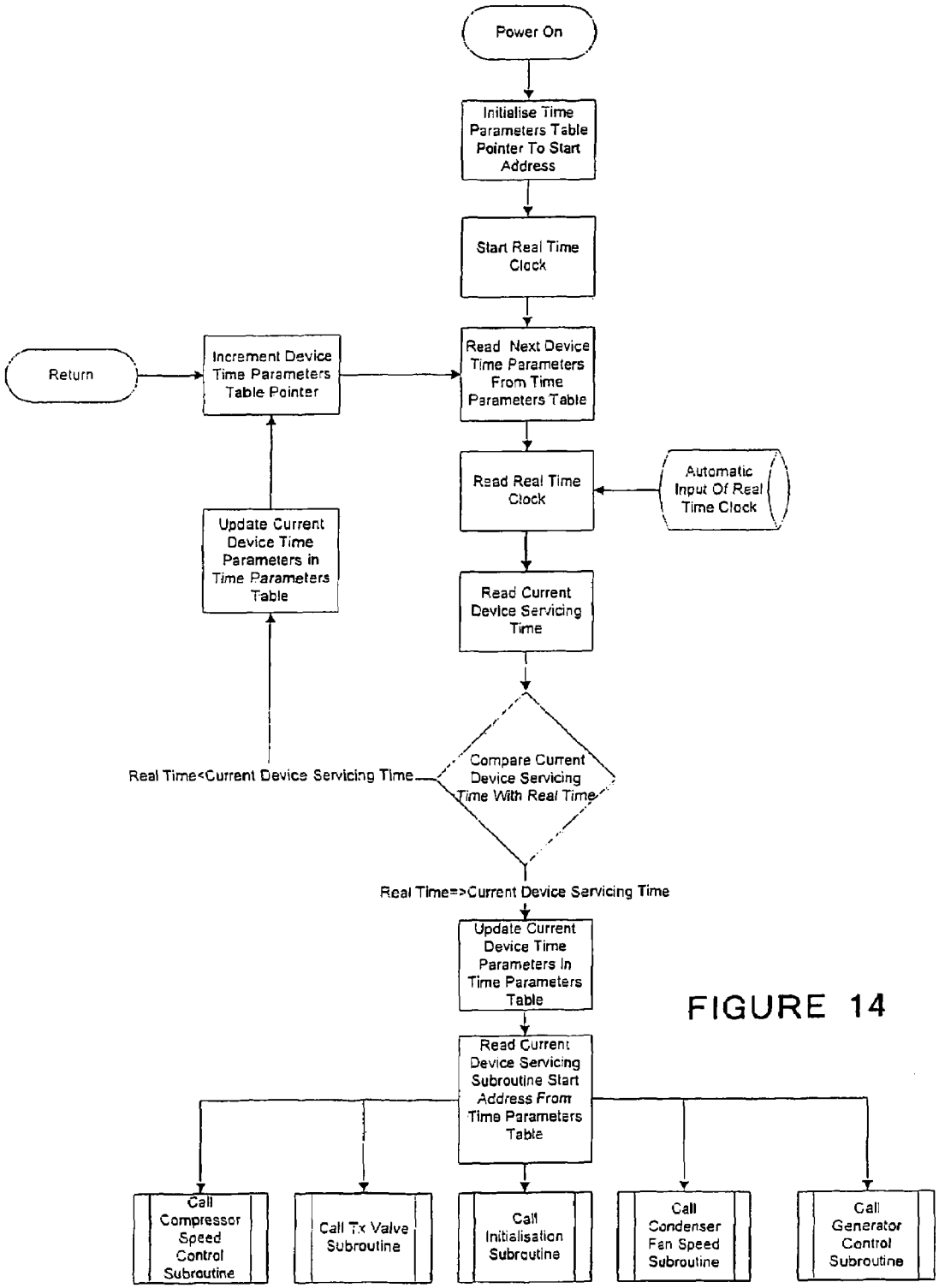
FIG. 14: Shows a flow chart of a scheduling subroutine for the control system.

FIG. 14 shows diagrammatically a control algorithm for the scheduling of control/optimisation algorithms described herein above. A table of time parameters is stored in memory, which specifies when each algorithm is to be executed. This table of time parameters will be entered by the heat pump administrator. On power up, a pointer is set to an initial value in the table of time parameters and the clock started. The table of time parameters lists sequentially all of the control algorithms, a time delay variable that indicates the time delay that should occur between each execution for that control algorithm and an address indicating where the control algorithm can be found in memory.

The microcontroller reads the current time of the real time clock and adds the time delay indicated in the time parameters table to give it the current servicing time. The current servicing time is then read and compared with the real time clock. The process continually cycles around a loop, checking the real time against the current servicing time for each algorithm, until the real time clock reaches the current servicing time for an algorithm. When this occurs, the microprocessor exits the loop, reads the start address for the algorithm from the time parameters table and executes the algorithm. After the algorithm has been executed, the microprocessor returns to the loop as indicated by "return" in FIG. 14.

The rotors in the generators of the heat pump may operate at high rotational speeds. For example the generators and heat pump may be designed so that the rotors revolve at 15000 rpm or more. To maintain the performance of the generator at high revolution speeds, it is necessary to balance the rotating group (turbine, rotor, shaft and bearing system). Also, sealing the rotor and generator into the refrigerant cycle may avoid problems with losses and reliability of transferring power of the cycle through a shaft. Furthermore, if a fixed magnet rotor is used, sensitive balancing becomes difficult due to the magnetic field about the rotor and the ferromagnetic components of the rig become magnetised and if a sudden load is applied to the generator, the resulting force can unbalance the rotor.

The generator of the present invention includes a rotor that is non-magnetic and can not become magnetised. The rotor may, for example, be produced from Lycore 150 electrical sheet steel. The electric field emanating from the rotor is controlled by coils provided on the rotor wound on high permeability F5 ferrite rod formers. Other suitable materials may be used.

The turbine components in close proximity to the rotor and the casing for the rotor may both be constructed from a suitable plastic resistant to the high stresses applied in the generator. These components therefore do not interfere with the electrical field from the rotor or the electrical field from energised stator windings. The stator windings are wound onto a toroidal core about the plastic casing. The toroidal core may be Lycore 150 electrical sheet steel or more preferably a high permeability specially moulded ferrite former of F5 ferrite or equivalent.

FIGS. 11A-D show a turbine generator generally referenced by arrow 500. The entire generator 500 may be sealed within the air conditioning cycle, FIG. 11A shows a top view of a turbine generator 500, with covers removed for clarity and FIG. 11B shows a section though line BB in FIG. 11A. The turbine generator 500 includes a turbine housing 501, a stator support housing 502 supporting a stator 504 and cover plates 503A-D. FIGS. 11C and 11D show a section through lines CC and DD in FIG. 11B respectively. The turbine housing 501 contains a turbine 505 including a rotor 506 and a nozzle 507 held in place by a nozzle retainer 508. The nozzle 507 is supplied with refrigerant through an inlet pipe 509. The generator rotor 510 includes four rotor coils 511-514 forming a four-pole rotor 510. The coils 511-514 may have their ends shorted together or connected by a resistive element which impedance/resistance increases with temperature to provide current limiting to protect the windings of the rotor. The coils may, for example, be formed from 1 mm copper and have 135 turns about a 19 mm F5 ferrite former. However, as will be appreciated by those skilled in the relevant arts, the number of windings in both the generator rotor 510 and stator 504, the core used for the windings, the air gap between the generator rotor 510 and stator windings and the number of poles provided on the generator rotor 510 can be varied according to the requirements for the generator 500. The turbine rotor 506 preferably has interrupters as described above with reference to FIG. 4, and may have a blade structure as described herein in relation to FIG. 4 or 5.

The windings of the stator 504 may be wired together in adjacent groups of two or more windings. The AC outputs of each winding group are connected to other groups at 90 degree intervals for the four pole rotor 510. The winding groups are each connected to a controlled DC generator (not shown) that is operable to feed a constant direct current though the stator windings. Capacitors isolate the windings and DC generator from the AC output. Winding groups are energised with a direct current creating alternate north and south pole pairs about the rotor, which may be at 90 degree intervals, with the like fields being placed opposite each other at 180 degree intervals. The electric field is therefore balanced around the rotor 510 and can if necessary be adjusted to correct any imbalance in the rotor 510 in response to any imbalance that may be detected during operation. The other stator windings will not have a DC generator connected to them. By way of example, there may be a total of 18 coil groups in the stator, with four connected to DC generators. Two, three or more than four stator windings connected to DC generators may be provided if required.

The polarity of the DC current can be reversed periodically to ensure that the ferromagnetic components in the turbine 500 do not acquire a permanent magnetic bias.

Turbines of the prior art have operating speed and torque characteristics that are fixed and can not be controlled without loss of performance. However, the turbine 500 of the present invention allows dynamic control of the strength of the exciting field, changing the characteristics of the generator so that the turbine 500 can be operated at the most favourable speed and torque to maintain operation within fixed parameters. For application to the turbines in the heat pumps described herein, the turbine 500 of the present invention may be used to maintain supersonic operation.

When the turbine 500 reaches its terminal velocity, the DC current generators are activated, causing an electric field to be generated by the stator windings connected to the generator, which generates an AC current in the coils of the rotor 510 as the rotor 510 rotates. AC current is then generated in the stator windings, which are fed to the generator output. The AC output may be rectified and if the generator forms part of a heat pump, the energy may be used to partially power a compressor in the heat pump.

Figure 12:
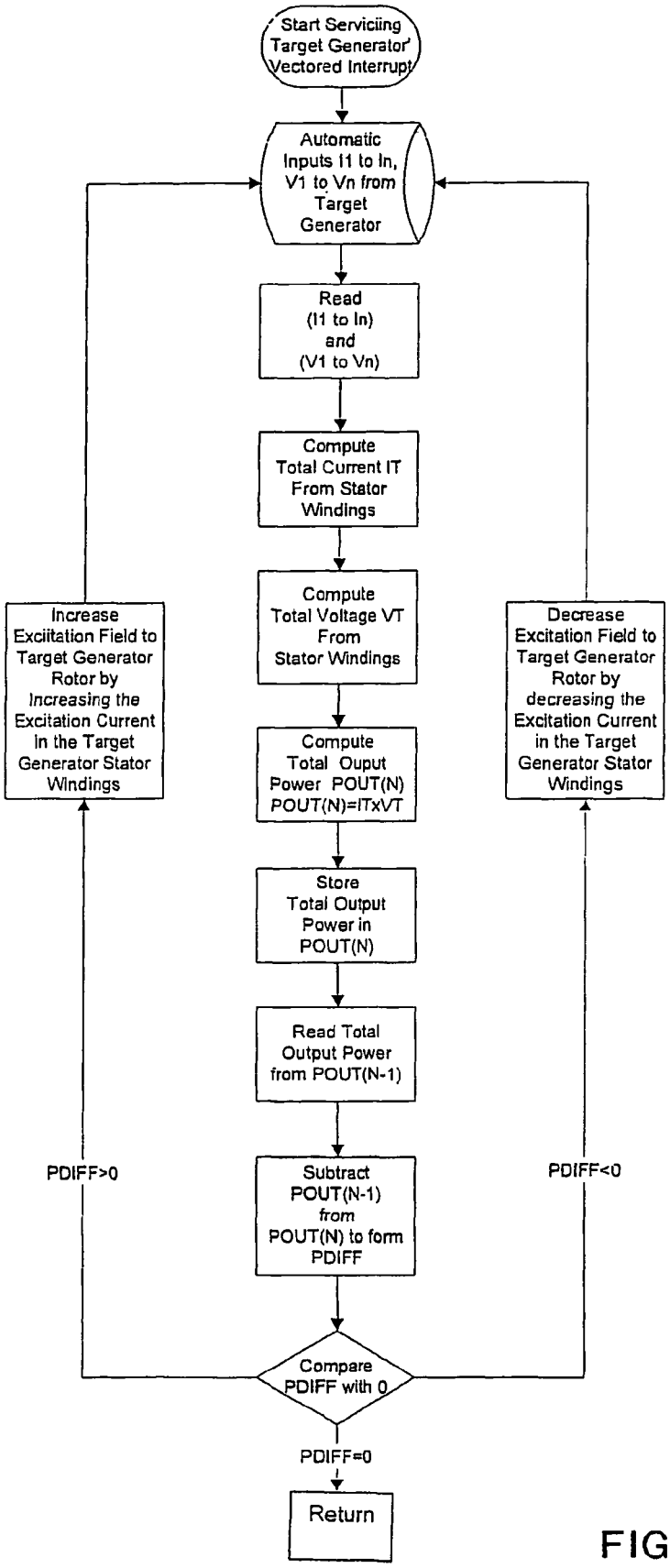

FIG. 12 shows diagrammatically a control algorithm for the stator windings. The control algorithm shown in FIG. 12 is used after the rotor 510 has been brought up to speed and direct current is being fed through the stator windings. The total current output IT and total voltage output VT from the stator is measured. This may be achieved by taking measurements of the current output Il-In and voltage output V1-Vn for each stator winding group. The total power output is computed as the product of IT and VT. This is compared to the previous power output. If the previous power output was less than the current power output, the direct current through the stator windings is increased by a predetermined step size. If the previous power output was more than the current power output, the direct current through the stator windings is decreased by a predetermined step size. Those skilled in the art will appreciate that the algorithm illustrated in FIG. 12 may use to control multiple target generators.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A thermodynamic cycle including a compressor, a first turbine downstream of the compressor, a heat exchanger located downstream of the first turbine and operable to reject heat from the cycle to another thermodynamic cycle, an evaporator downstream of the heat exchanger and a second turbine downstream of the evaporator and upstream of the compressor.

2. The thermodynamic cycle of claim 1, wherein at least one of the first and second turbines includes a rotor including two or more spaced apart rotor windings and a stator including a plurality of stator windings about said rotor, wherein at least two of said stator windings are connected to a controllable current source, each controllable current source operable to energize the stator windings to which it is connected.

3. The thermodynamic cycle of claim 2, wherein each controllable current source is operable to energize the stator windings to which it is connected after the rotor has reached a predetermined velocity.

4. The thermodynamic cycle of claim 3, wherein the predetermined velocity is the terminal velocity for the current operating conditions of the turbine.

5. The thermodynamic cycle of claim 2, wherein each current source increases or decreases the current through their respective stator windings dependent on a measure of the power output from the stator windings.

6. A method of control for the thermodynamic cycle claimed in claim 2 including repeatedly measuring the power output from the stator windings and increasing the current through the windings if the current measure of power output is greater than a previous measure of power output and decreasing the current through the windings if the current measure of power output is less than a previous measure of power output.

7. A control system for the thermodynamic cycle claimed in claim 2, the control system including:

sensing means for providing a measure of an output of the thermodynamic cycle;

control means for the compressor, wherein the control means is in communication with said sensing means to receive as inputs said measure of an output of the thermodynamic cycle and a measure of the work input of the compressor; and wherein the control means is operable to compute a measure of efficiency from said inputs and vary the speed of the compressor to maximise said measure of efficiency or to maintain said measure of efficiency at a predetermined level and wherein the control system is operable to control the direct current through the stator windings of said turbine.

8. The control system of claim 7, operable to control the direct current through the stator windings to dynamically maintain the balance of said turbine when loaded.

9. A control system for the thermodynamic cycle claimed in claim 1, the control system including:

sensing means for providing a measure of an output of the thermodynamic cycle;

control means for the compressor, wherein the control means is in communication with said sensing means to receive as inputs said measure of an output of the thermodynamic cycle and a measure of the work input of the compressor; and wherein the control means is operable to compute a measure of efficiency from said inputs and vary the speed of the compressor to maximise said measure of efficiency or to maintain said measure of efficiency at a predetermined level.

10. The control system of claim 9, further including second control means for the second turbine and sensing means for providing a measure of the temperature of a controlled area, wherein the second control means receives as a further input said measure of the temperature of a controlled area, and is operable to open or close the fluid flow path through said second turbine in response to sensed variations in temperature in the controlled area in relation to a target measure.

11. The control system of claim 9, wherein the second control means further receives as an input a measure indicative of the amount of refrigerant in the cycle which is vaporised after an evaporation phase in the cycle and to open or close the fluid flow path through said second turbine to maintain vaporized refrigerant after the evaporation phase.

12. The control system of claim 9, wherein the operation of the second control means to maintain vaporised refrigerant after the evaporation phase is performed after a predetermined delay from the control means opening or closing the fluid flow path through said second turbine in response to said sensed variations of temperature.

13. The control system of claim 9 including third control means for a condenser in the thermodynamic cycle, the control system varying the operation of the condenser to maintain a required level of cooling of refrigerant by the condenser.

14. The control system of claim 13, wherein the control means, second control means and third control means is a single microcontroller or microprocessor or a plurality of microcontrollers or microprocessors with at least selected microcontrollers or microprocessors in communication with each other to allow management of the timing of the functions of the control system.

15. A thermodynamic cycle including a compressor, a condenser downstream of the compressor, a first turbine downstream of the condenser, an evaporator downstream of the first turbine and a second turbine downstream of the evaporator and upstream of the compressor.

16. The thermodynamic cycle of claim 15 further including a heat exchanger located between said first turbine and said evaporator, the heat exchanger operable to reject heat to another thermodynamic cycle.

17. The thermodynamic cycle of claim 15, wherein at least one of the first turbine and second turbine includes:

a rotor chamber;

a rotor rotatable about a central axis within said rotor chamber;

at least one nozzle including a nozzle exit for applying a fluid a fluid supply in the thermodynamic cycle to said rotor to thereby drive said rotor and generate power;

at least one exhaust aperture to, in use, exhaust said fluid from said turbine; and wherein the flow of said fluid from said at least one nozzle exit is periodically interrupted by at least one flow interrupter means, thereby raising the pressure of said fluid inside said at least one nozzle.

18. The thermodynamic cycle of claim 17, wherein the at least one of the first turbine and second turbine includes at least one fluid storage means between said fluid supply and said at least one nozzle.

19. The thermodynamic cycle of claim 18, wherein said fluid storage means has a capacity at least equal to a displacement of the compressor.

20. The thermodynamic cycle of claim 17, wherein said at least one flow interrupter means substantially stops the flow of said fluid from said at least one nozzle exit until the pressure inside said at least one nozzle rises to a preselected minimum pressure, which is less than or equal to the pressure of the fluid supply.

21. The thermodynamic cycle of claim 17, wherein in use, said flow of said fluid from said at least one nozzle is interrupted by said at least one interrupter means for a period sufficient to bring said fluid immediately upstream of said at least one outer nozzle substantially to rest.

22. The thermodynamic cycle of claim 17, wherein said rotor has a plurality of channels shaped, positioned and dimensioned to provide a turning moment about said central axis when refrigerant from said at least one nozzle enters said channels.

23. The thermodynamic cycle of claim 17, wherein said rotor is has a plurality of blades shaped, positioned and dimensioned to provide a turning moment about said central axis when refrigerant from said at least one nozzle contacts said blades.

24. The thermodynamic cycle of claim 17, wherein said at least one flow interrupter means includes at least one vane connectable to and moveable with an outer periphery of said rotor and adapted to interrupt the flow of said fluid out of said at least one outer nozzle exit when said at least one vane is substantially adjacent said at least one nozzle exit.

25. The thermodynamic cycle of claim 24, wherein said flow interrupter means includes a plurality of said vanes substantially evenly spaced apart around said outer periphery of said rotor.

26. The thermodynamic cycle of claim 17, wherein said at least one nozzle in use supplies said fluid to said rotor at a sonic or supersonic velocity.

27. The thermodynamic cycle of claim 26, wherein said at least one exhaust aperture includes diffuser and expander sections to decrease the velocity of said fluid and maintain the pressure of the fluid flow once it has decelerated to a subsonic velocity.

28. A method of generating power from a thermodynamic cycle including a compressor, a first turbine downstream of the compressor, a heat exchanger located downstream of the first turbine and operable to reject heat from the cycle to another thermodynamic cycle, an evaporator downstream of the heat exchanger and a second turbine downstream of the evaporator and upstream of the compressor, wherein the first second turbines include a rotor and at least one nozzle to apply fluid to the rotor to thereby drive said rotor and generate power;

the method including providing at least one flow interrupter means to periodically interrupt the flow of said fluid out of said at least one nozzle, thereby raising the pressure of said fluid inside said at least one nozzle to a preselected minimum pressure which is less or equal to said fluid supply means pressure before resuming the flow of said fluid out of said at least one nozzle.

29. A method of generating power from a thermodynamic cycle including a compressor, a condenser downstream of the compressor, a first turbine downstream of the condenser, an evaporator downstream of the first turbine and a second turbine downstream of the evaporator and upstream of the compressor wherein the first second turbines include a rotor and at least one nozzle to apply fluid to the rotor to thereby drive said rotor and generate power;

the method including providing at least one flow interrupter means to periodically interrupt the flow of said fluid out of said at least one nozzle, thereby raising the pressure of said fluid inside said at least one nozzle to a preselected minimum pressure which is less or equal to said fluid supply means pressure before resuming the flow of said fluid out of said at least one nozzle.

30. The method of claim 29, wherein said preselected minimum pressure is sufficient to cause the fluid to reach the local sonic velocity at a throat of the nozzle.

31. The method of claim 30, including accelerating fluid exiting said at least one nozzle to supersonic velocities.

* * * * *